US008186008B2

(12) United States Patent
Han et al.

(10) Patent No.: US 8,186,008 B2
(45) Date of Patent: May 29, 2012

(54) AGITATOR AND SUCTION NOZZLE FOR VACUUM CLEANER HAVING THE SAME

(75) Inventors: Jung-gyun Han, Gwangju (KR); Joung-soo Park, Jeonju-si (KR); Byung-Jo Lee, Gwangju (KR); Tae-gwang Kim, Gwangju (KR); See-hyun Kim, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 1045 days.

(21) Appl. No.: 12/152,958

(22) Filed: May 19, 2008

(65) Prior Publication Data

US 2009/0165241 A1 Jul. 2, 2009

(30) Foreign Application Priority Data

Jan. 2, 2008 (KR) ..... 10-2008-0000419

(51) Int. Cl.
*A47L 5/30* (2006.01)

(52) U.S. Cl. ..... 15/366; 15/383

(58) Field of Classification Search ..... 15/340.3, 15/363, 366, 383, 179; *A47I 5/30*
See application file for complete search history.

(56) References Cited

U.S. PATENT DOCUMENTS

| | | | | |
|---|---|---|---|---|
| 2,734,211 | A * | 2/1956 | Vance | 15/183 |
| 6,032,327 | A * | 3/2000 | Oka et al. | 15/346 |
| 6,079,079 | A * | 6/2000 | Oka | 15/375 |
| 6,314,611 | B1 | 11/2001 | Sauers | |

FOREIGN PATENT DOCUMENTS

| | | |
|---|---|---|
| KR | 1020010055149 | 7/2001 |
| KR | 1020040023286 | 3/2004 |

OTHER PUBLICATIONS

British Combined Search and Examination Report dated Nov. 28, 2008 corresponding to Application No. GB0813859.6.

* cited by examiner

*Primary Examiner* — David Redding
(74) *Attorney, Agent, or Firm* — Ohlandt, Greeley, Ruggiero & Perle, LLP

(57) ABSTRACT

An agitator includes an agitator body rotatably accommodated within a suction nozzle having a suction port, and comprising a plurality of bristles planted in an outer circumference, and an air moving device formed on the outer circumference of the agitator body to cause air to move in a space defined between the agitator body and an inner wall of the suction nozzle, if the agitator body is rotated.

13 Claims, 4 Drawing Sheets

AGITATOR AND SUCTION NOZZLE FOR VACUUM CLEANER HAVING THE SAME

CROSS-REFERENCE TO RELATED APPLICATIONS

This application claims the benefit under 35 U.S.C. §119 (a) of Korean Patent Application No. 10-2008-0000419, filed on Jan. 2, 2008, in the Korean Intellectual Property Office, the entire contents of which are hereby incorporated by reference.

BACKGROUND OF THE INVENTION

1. Field of the Invention

The present disclosure relates to a vacuum cleaner. More particularly, the present disclosure relates to an agitator disposed within a suction nozzle to agitate the air, and a suction nozzle of a vacuum cleaner having the same.

2. Description of the Related Art

A vacuum cleaner uses a negative pressure generated from a vacuum suction motor housed inside a cleaner body to draw in air and dust from an object being cleaned. As the vacuum cleaner draws in air and dust, dust is separated from the indrawn air and collected in a dust separating device.

An agitator having a plurality of bristles planted therein is rotatably accommodated within a suction nozzle, to facilitate the separation of dust from an object being cleaned such as a carpeted floor (hereinafter a "work surface"). Specifically, the agitator hits the work surface to cause the dust particles to be scattered so that the suction nozzle can more easily draw in dust particles.

FIG. 1 illustrates an example of a suction nozzle having a conventional agitator.

The agitator 20 has a plurality of bristles 21 planted therein, and is accommodated within the suction nozzle 10. The dust particles, when brushed up by the agitator 20, are directly drawn towards an extension pipe 30 especially in the proximity to a suction port near a connector 11 that connects to the extension pipe 30. However, dust particles (d) hovering around both ends of the suction nozzle 10 are not efficiently drawn, since the vacuum does not influence the ends of the suction nozzle 10 as strongly as it does in the proximity to the connector 11 that connects to the extension pipe 30.

The dust particles (d) staying around both ends of the suction nozzle 10 are eventually piled on both ends, and cause serious problems such as secondary contamination of a work surface, or obstructed rotation of the agitator 20.

BRIEF SUMMARY OF THE INVENTION

An aspect of the present disclosure is to address at least the above problems and/or disadvantages and to provide at least the advantages described below. Accordingly, an aspect of the present disclosure is to provide an agitator improved in structure to prevent piling of dust particles inside a suction nozzle, and a suction nozzle of a vacuum cleaner having the agitator.

In accordance with an aspect of the present disclosure, an agitator includes an agitator body rotatably accommodated within a suction nozzle having a suction port, and comprising a plurality of bristles planted in an outer circumference, and an air moving device formed on the outer circumference of the agitator body to cause an air to move in a space defined between the agitator body and an inner wall of the suction nozzle, if the agitator body is rotated.

The air moving device may include a first air moving unit formed on a first portion of the outer circumference of the agitator body, and a second air moving unit formed on a second portion of the outer circumference of the agitator body opposite to the first portion, and the first and second air moving units cause air to move in opposite directions.

The first and second air moving units may be formed integrally with the outer circumference of the agitator body.

The first and second air moving units may include a plurality of arc-shaped guide vanes that are curved opposite to each other.

The arc-shaped guide vanes may be arranged at constant intervals both in a direction of an axis of the agitator body and in a direction perpendicular to the axis of the agitator body. The arc-shaped guide vanes may be arranged not to overlap with the plurality of bristles.

In accordance with an aspect of the present disclosure, a suction nozzle of a vacuum cleaner may include the agitator described above.

According to the present disclosure, air current is generated within the suction nozzle in the direction toward the suction port connected to the extension pipe, to prevent dust particles brushed up by the agitator from piling in the suction nozzle.

BRIEF DESCRIPTION OF THE SEVERAL VIEWS OF THE DRAWINGS

The above and other objects, features, and advantages of certain exemplary embodiments of the present disclosure will be more apparent from the following description taken in conjunction with the accompanying drawings, in which.

DETAILED DESCRIPTION OF THE INVENTION

Hereinafter, the first and second exemplary embodiments of the present disclosure will be described in detail with reference to the accompanying drawing figures.

Figure 2:
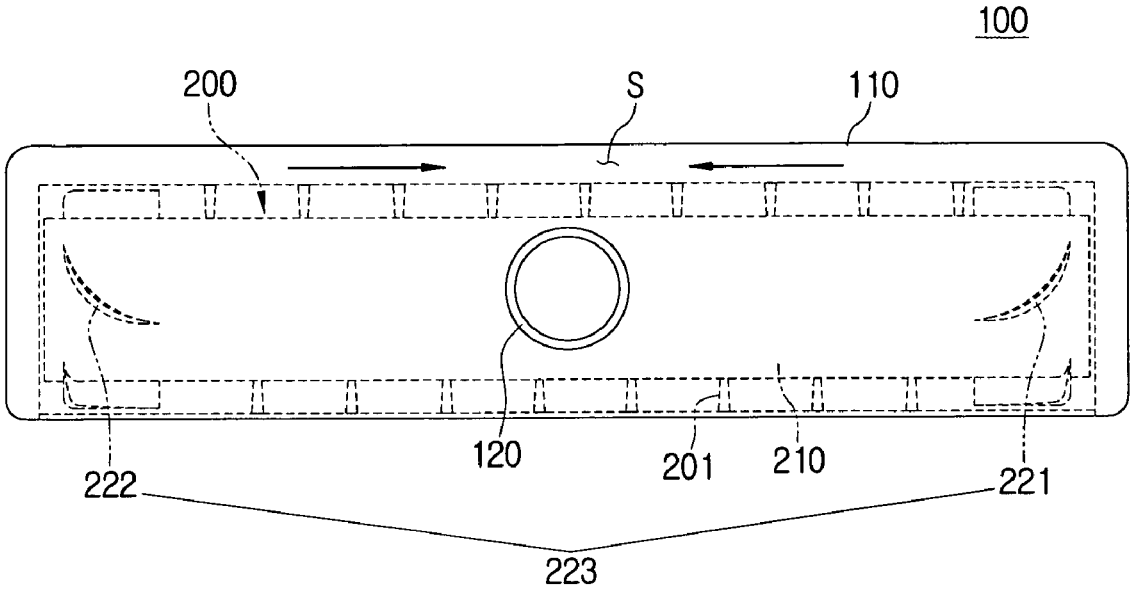
FIG. 2 illustrates a suction nozzle having an agitator according to a first exemplary embodiment of the present disclosure.
Figure 3:
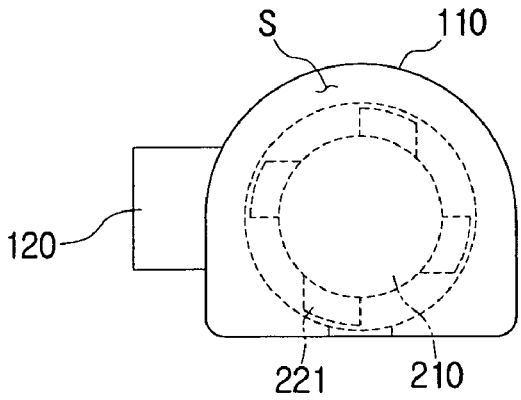
FIG. 3 is a side view of FIG. 2.

Referring to FIGS. 2 and 3, a suction nozzle 100 according to a first exemplary embodiment of the present disclosure includes an agitator 200 rotatably accommodated within a suction nozzle body 110.

The suction nozzle 100 includes a suction port 120. A connector is provided to connect the suction port 120 to an extension pipe, so that the suction port 120 is connected to a main cleaner body (not illustrated).

The agitator 200 includes an agitator body 210 and an air moving device 223.

Figure 1:
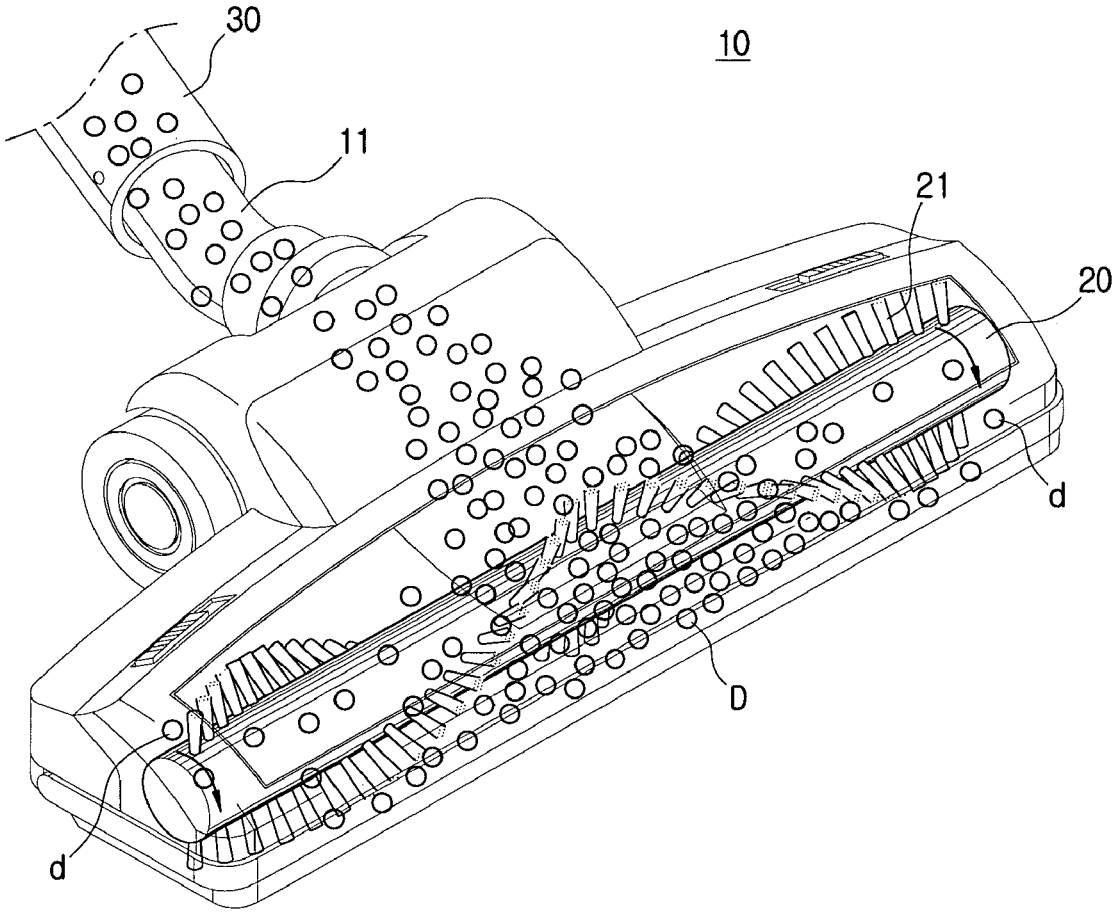
FIG. 1 (PRIOR ART)
FIG. 1 illustrates a suction nozzle having a conventional agitator.

The agitator body 210 is provided in a cylindrical configuration, and includes a plurality of bristles 201 planed along an outer circumference. The bristles 201 may be planted substantially parallel to an axis of the agitator body 210 (FIGS. 2 and 4), or alternatively, may be planted in a sine wave arrangement (FIG. 1).

The air moving device 223 includes a first and second air moving units 221 and 222 formed on both ends of the agitator body 210, and operates to form an air current in a space (S) defined between an inner side of the suction nozzle body 110 and an outer side of the agitator body 210.

The first and second air moving units 221 and 222 include a plurality of arc-shaped guide vanes arranged along an outer circumference of the agitator body 210 at predetermined intervals. The first and second air moving units 221 and 222 may be integrally formed with the agitator body 210, or, alternatively, may be formed separately to be attached to the agitator body 210.

Meanwhile, the first and second air moving units 221 and 222 having a plurality of arc-shaped guide vanes are curved opposite to each other to cause the air to move from two end areas of the suction nozzle 100 towards the center where the suction port 120 is formed. Accordingly, as the agitator 200 is rotated, the air in the space (S) defined between the inner side of the suction nozzle 100 and the outer side of the agitator 200 is guided to flow from the end areas of the suction nozzle 100 towards the center area. According to this air current, dust particles brushed up from a work surface near the two ends of the suction nozzle 100 are moved efficiently toward the suction port 120.

While the first air moving unit 221 illustrated in FIG. 3 includes four arc-shaped guide vanes arranged at substantially right angles, this is according to an exemplary embodiment of the present disclosure. Accordingly, two, three, four or more than four guide vanes may be employed as necessary. Although not illustrated, the second air moving unit 222 is formed in symmetry, at the opposite end of the agitator 200. The first and second air moving units 221 and 222 may have a variety of arrangements, provided that these are formed on both ends of the agitator 200 to form an air current oriented towards the suction port 120.

Figure 4:
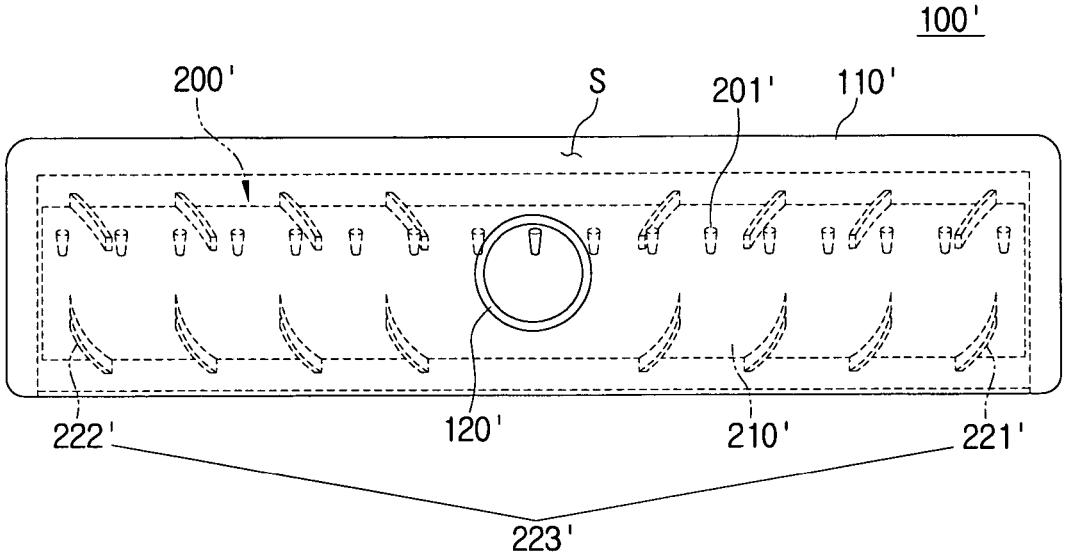
FIG. 4 illustrates a suction nozzle having an agitator according to a second exemplary embodiment of the present disclosure.
Figure 5:
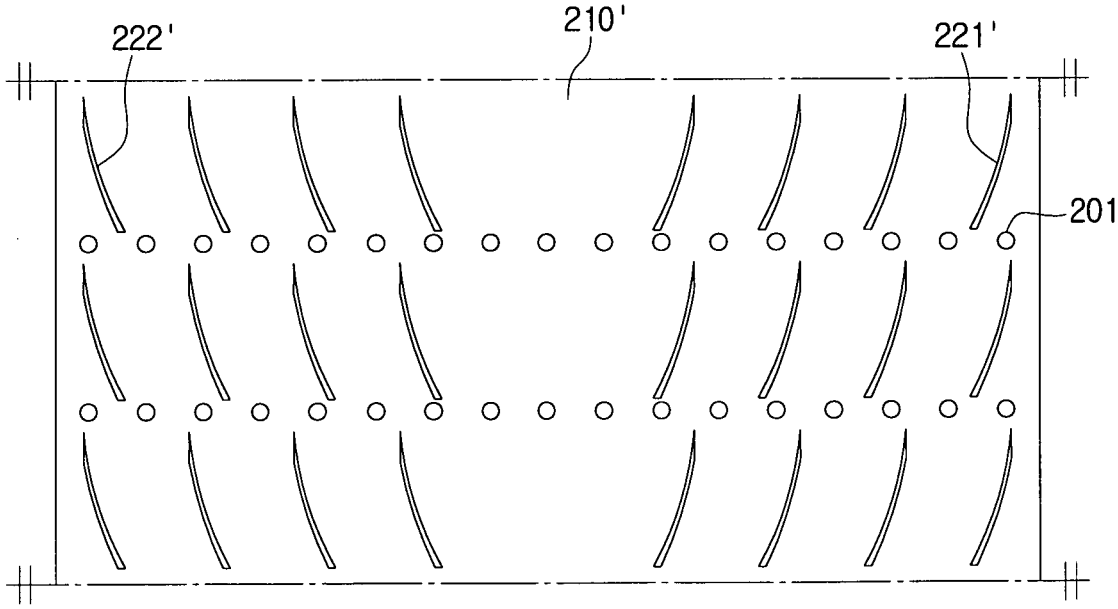
FIG. 5 is a development drawing of an agitator according to the second exemplary embodiment of the present disclosure.

FIGS. 4 and 5 illustrate a suction nozzle 100' having an agitator 200' according to a second exemplary embodiment of the present disclosure.

The agitator 200', having an air moving device 223' in which a plurality of guide vanes are formed, is rotatably received in the suction nozzle 100'.

The suction nozzle 100' includes a suction port 120' formed approximately at the center, and an extension pipe (not illustrated) is connected to the suction port 120' to apply the suction nozzle 100 a vacuum generated by a vacuum suction motor of a main cleaner body (not illustrated). The above elements of the second exemplary embodiment are almost identical to those explained in the first exemplary embodiment.

The agitator 200' includes an agitator body 210' and an air moving device 223'. A plurality of bristles 201 are planed in the agitator 200'.

The air moving device 223' includes a first and second air moving units 221' and 222', which may be provided in the form of a plurality of arc-shaped guide vanes that are curved oppositely to each other with reference to the suction port 120'.

Referring to the development drawing illustrated in FIG. 5, the first and second air moving units 221' and 222' are arranged at constant intervals, both in a direction parallel to the axis of the agitator body 210' and in a direction perpendicular to the axis of the agitator body 210'. As a result, air currents with opposite orientations are generated while the agitator 200' is rotated.

The first and second air moving units 221' and 222' may not be formed at locations to face the suction port 120' of the agitator 210', in consideration of the fact that the first and second air moving units 221' and 222' are formed to facilitate the flow of air from both ends of the suction nozzle 100' towards the suction port 120', and that it is unnecessary to form an air current at a location that faces the suction port 120'.

Furthermore, the first and second air moving units 221' and 222' may desirably be arranged not to interfere with the bristles 201. If the first and second air moving units 221' and 222' interfere with the bristles 201, the bristles 201 may interrupt the air flow between the first and second air moving units 221' and 222', or the first and second air moving units 221' and 222' may hinder the bristles 201 from hitting the work surface.

Figure 6:
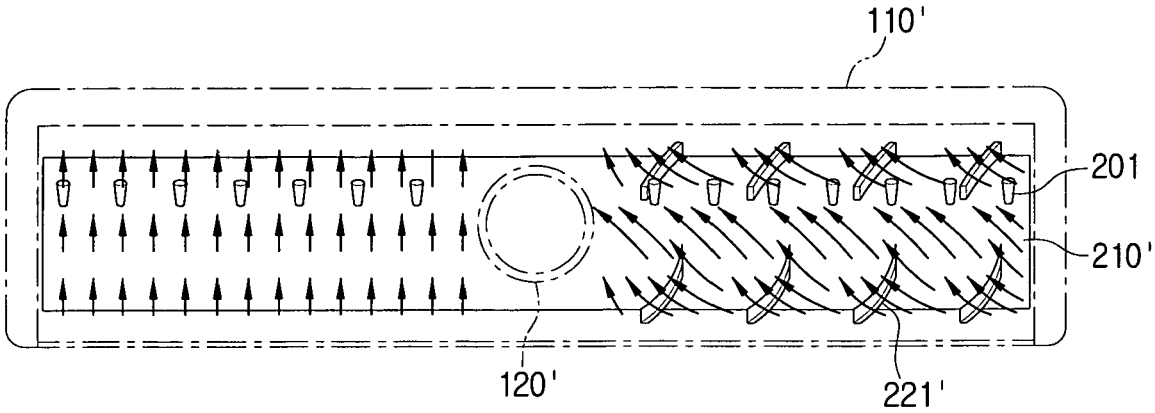
FIG. 6 illustrates different paths of dust particles according to whether these are brushed up by a conventional agitator or an agitator according to an exemplary embodiment of the present disclosure.

FIG. 6 is a view to compare efficiency of the conventional agitator and that of the agitator 200' according to the exemplary embodiments of the present disclosure. Specifically, FIG. 6 illustrates an example in which the conventional agitator is formed in the left portion while the agitator according to the second exemplary embodiment of the present disclosure is formed in the right portion.

As the cleaning operation begins using the suction nozzle, dust particles brushed up by the bristles are scarcely moved to the suction port in the left portion, while the dust particles brushed up by the bristles 201 having the air moving device 223' are efficiently carried towards the suction port 120' along the air generated by the air moving device 223' in the right portion. As a result, dust particles are not piled in the right portion of the suction nozzle.

Although not illustrated, the suction port 120 or 120' may be arranged closer to one or the other end of the suction nozzle 100 or 100', instead of being provided in the center portion, according to a specific effect intended by a designer. In this case, the air moving device 223' may not be necessarily provided around the suction port 120 or 120' of the agitator 200.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. An agitator comprising:

an agitator body, comprising a plurality of bristles planted in an outer circumference thereof, the agitator body being rotatably disposed within a suction nozzle having a central suction port; and first and second air moving units formed on an outer circumference of the agitator body to cause air to move in a space toward the central suction port when the agitator body is rotated, the space being defined between the agitator body and an inner wall of the suction nozzle, wherein the first and second air moving units cause air to move in opposite directions.

2. The agitator of claim 1, wherein the first air moving unit is formed on a first portion of the outer circumference of the agitator body; and the second air moving unit is formed on a second portion of the outer circumference of the agitator body opposite to the first portion.

3. The agitator of claim 2, wherein the first and second air moving units are formed integrally with the outer circumference of the agitator body.

4. The agitator of claim 3, wherein the first and second air moving units comprise a plurality of arc-shaped guide vanes that are curved opposite to each other.

5. The agitator of claim 4, wherein the plurality of arc-shaped guide vanes are arranged at constant intervals both in a direction of an axis of the agitator body and in a direction perpendicular to the axis of the agitator body.

6. The agitator of claim 5, wherein the plurality of arc-shaped guide vanes are arranged not to overlap with the plurality of bristles.

7. A suction nozzle of a vacuum cleaner, comprising:

a suction nozzle body comprising a central suction port; and an agitator rotatably disposed within the suction nozzle body, wherein the agitator comprises:

an agitator body comprising a plurality of bristles planted in an outer circumference thereof, and first and second air moving units formed on an outer circumference of the agitator body to cause air to move in a space toward the central suction portion when the agitator body is rotated, the space being defined between the agitator body and an inner wall of the suction nozzle, wherein the first and second air moving units cause air to move in opposite directions.

8. The suction nozzle of claim 7, wherein the first air moving unit is formed on a first portion of the outer circumference of the agitator body; and the second air moving unit is formed on a second portion of the outer circumference of the agitator body opposite to the first portion.

9. The suction nozzle of claim 8, wherein the first and second air moving units are formed integrally with the outer circumference of the agitator body.

10. The suction nozzle of claim 9, wherein the first and second air moving units comprise a plurality of guide vanes having an arcuate shape.

11. The suction nozzle of claim 10, wherein the plurality of guide vanes are arranged at constant intervals both in a direction of an axis of the agitator body and in a direction perpendicular to the axis of the agitator body.

12. The suction nozzle of claim 11, wherein the plurality of guide vanes are arranged not to overlap with the plurality of bristles.

13. The suction nozzle of claim 10, wherein the arcuate shape of the plurality of guide vanes of the first air moving unit has a first curvature, and wherein;

the arcuate shape of the plurality of guide vanes of the second air moving unit has a second curvature, and wherein;

the first curvature is opposite to the second curvature.

* * * * *